US005632661A

United States Patent [19]

Jürgens et al.

[11] Patent Number: 5,632,661

[45] Date of Patent: May 27, 1997

[54] DEVICE, SUCH AS A PROPELLER, FOR SHIPS WHICH IS INDEPENDENT OF THE MAIN PROPELLER PROPULSION SYSTEM AND CAN BE USED AS AN ACTIVE MANEUVERING MECHANISM

[75] Inventors: Dirk Jürgens, Hamburg; Christian Thieme, Brunstorf, both of Germany

[73] Assignee: Blohm +Voss International GmbH, Hamburg, Germany

[21] Appl. No.: 546,247

[22] Filed: Oct. 20, 1995

[30] Foreign Application Priority Data

Oct. 21, 1994 [DE] Germany ..... 44 37 649.9
Dec. 3, 1994 [DE] Germany ..... 44 43 100.7

[51] Int. Cl.[6] ..... B63H 1/08

[52] U.S. Cl. ..... 440/93; 114/146; 114/144 R

[58] Field of Search ..... 416/108, 111, 416/111 A, 110; 440/93, 92, 150; 114/144 R, 146, 162, 163

[56] References Cited

U.S. PATENT DOCUMENTS

| | | | |
|---|---|---|---|
| 1,618,549 | 2/1927 | O'Toole | 416/111 |
| 3,134,443 | 5/1964 | Snow | 440/93 |
| 3,716,014 | 2/1973 | Laucks et al. | 440/93 |
| 4,419,085 | 12/1983 | Laucks et al. . | |
| 4,465,431 | 8/1984 | Gross . | |
| 5,082,423 | 1/1992 | Morgan . | |

FOREIGN PATENT DOCUMENTS

| | | | |
|---|---|---|---|
| 0838865 | 7/1949 | Germany . | |
| 1941652 | 3/1971 | Germany . | |
| 358656 | 4/1938 | Italy | 440/93 |
| 9302913 | 2/1993 | WIPO . | |

*Primary Examiner*—Edwin L. Swinehart
*Attorney, Agent, or Firm*—Nils H. Ljungman and Associates

[57] ABSTRACT

Device which is independent of the main propulsion system of a ship, and which can be used selectively as a passive rudder or as an active maneuvering mechanism, and consists of one or more blades, a wheel body, a transmission and one or more control units.

When the wheel body is stationary, in response to commands from the control unit or units, the blades can be oriented separately by means of the transmission and can be coupled or uncoupled to set the required angle with respect to the longitudinal axis of the ship. In that case, the device acts as a passive rudder.

When the wheel body is rotating, the position of the eccentrically located blade or blades is varied during a rotation of the wheel body so that a resulting thrust is generated on account of the hydrodynamic forces which act on the blade or blades. The direction of the thrust can be set in any desired direction by means of the control unit or control units and the sun wheel or the sun wheels of the transmission. In that case, the device acts as an active maneuvering mechanism.

20 Claims, 7 Drawing Sheets

Fig. 3a
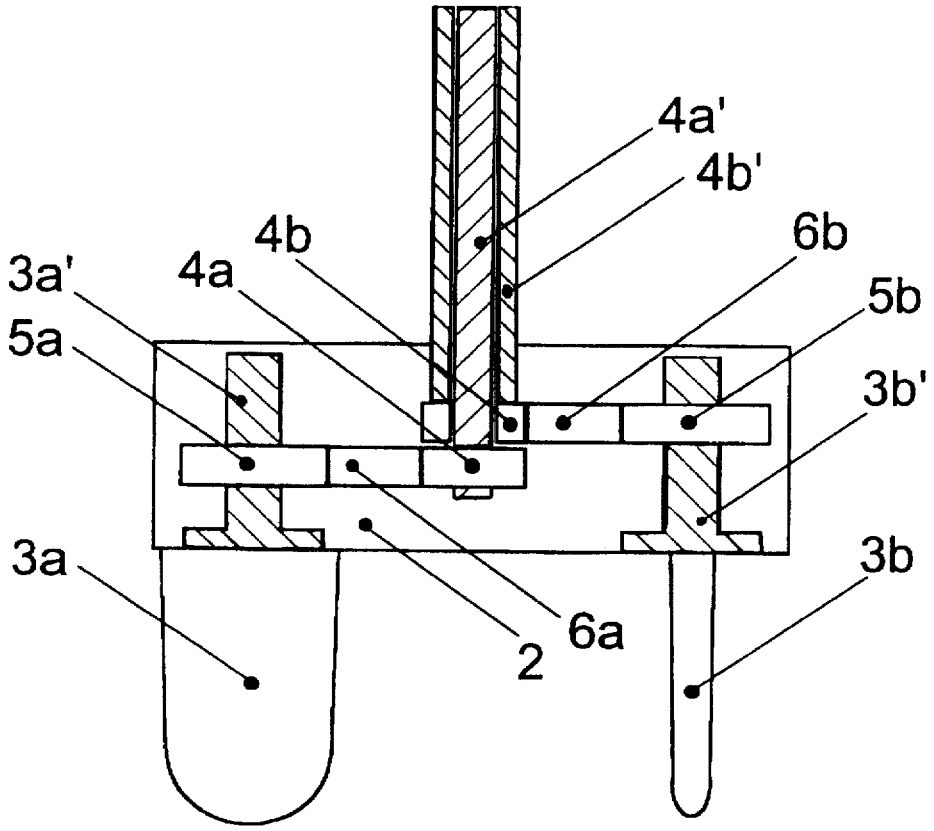
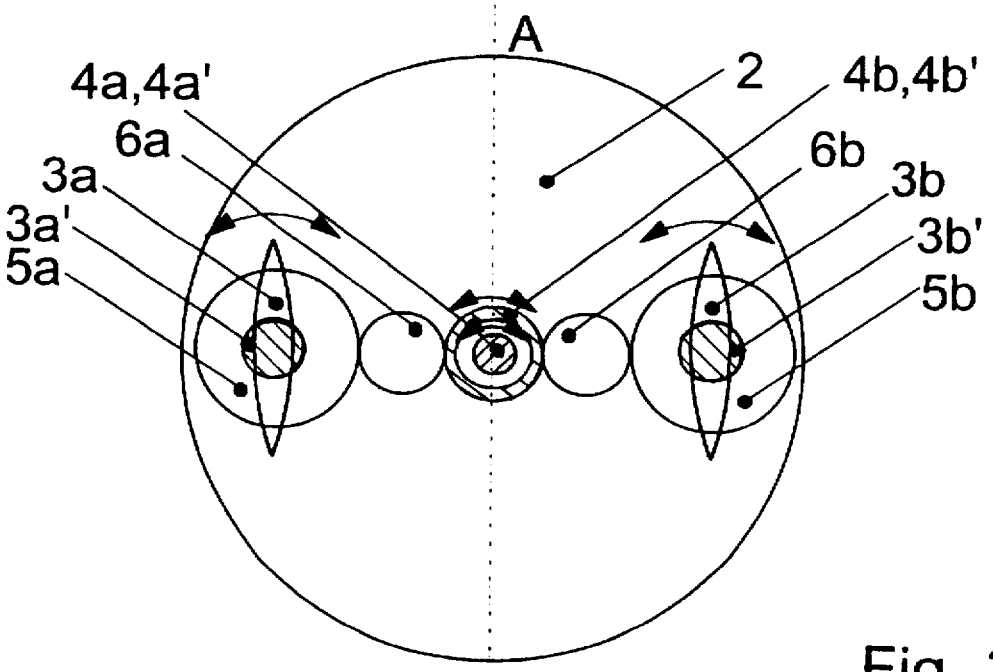
Fig. 3b

DEVICE, SUCH AS A PROPELLER, FOR SHIPS WHICH IS INDEPENDENT OF THE MAIN PROPELLER PROPULSION SYSTEM AND CAN BE USED AS AN ACTIVE MANEUVERING MECHANISM

BACKGROUND OF THE INVENTION

1. Field of the Invention

The present invention relates to a device for ships which is independent of the main propulsion system and can be used as an active maneuvering mechanism.

2. Background Information

Known devices of this type, e.g. as disclosed in German Patent Publication Published for Opposition Purposes No. 19 41 652, make it possible to maneuver ships in any desired direction, but the Voith-Schneider propeller which is used in the known systems cannot essentially be used as a passive, energy-saving rudder at cruising speed. The reason lies in the kinematics of the Voith-Schneider propeller and in the number of its blades, which do not tend to permit a low-resistance orientation of the blades in the longitudinal direction of the ship or at a required or specified rudder angle or below a required or specified rudder angle. Using the Voith-Schneider propeller, it is generally not possible to realize a required course angle, or track angle, or route angle, or a change in course of the ship, without an active input of energy.

OBJECT OF THE INVENTION

An object of the present invention is to eliminate these disadvantages and accordingly to improve a device like the Voith-Schneider propeller so that, with relatively little design and construction effort and expense, a device can be created which selectively makes available a passive, low-resistance rudder action at cruising speed or, in particular when the ship is travelling at low speeds, a high thrust which can be directed in any direction, as a result of active movement of the blades.

SUMMARY OF THE INVENTION

The invention teaches that this object can be accomplished by means of embodiments of the present invention, whereby, one one hand, the use of a planetary transmission makes possible the required rudder deflections when the device is used passively, and on the other hand, when the device is used actively, and when the wheel body is in rotation, the planetary transmission creates an inflow to the blade which results in a strong directional thrust.

German Patent No. 8 38 865 and U.S. Pat. No. 5,082,423 disclose the use of planetary transmissions as means for power transmission, these being equipped with a central sun wheel, intermediate wheels which are engaged with the sun wheel, and planetary wheels which are engaged with the intermediate wheels and support propulsion mechanisms. However, the known propulsion mechanisms cannot be pivoted around vertical axes, so that such propulsion mechanisms essentially correspond to paddle-wheel propulsion systems of the conventional type, and the paddles cannot be set or adjusted independently of one another. The known devices do not have special maneuvering capabilities.

To work effectively, a propeller preferably should be turned an ideal number of revolutions with respect to the level of power desired. Propellers with fixed blades, or with blades that do not allow 360° of rotation, tend to hinder the ability of the engine to turn the propeller the ideal number of revolutions. The Voith-Schneider propeller does not have fixed blades, and does allow some movement of the blades, however the blades cannot rotate a full 360°. Essentially, the Voith-Schneider propeller is a horizontal disc, from which blades project vertically. As the horizontal disc and the blades rotate around a vertical axis, a mechanism allows the blades to "feather", or to move to provide a thrust in the desired direction. The desired directional thrust can then be obtained by changing the sequence of the blades' movement. The present invention, however, in accordance with at least one preferred embodiment, unlike the Voith-Schneider propeller, allows the blades of the propeller to rotate 360°. By doing so, the present invention can not only be used as a passive, low-resistance rudder when the ship is cruising at high speeds, but the present invention can also be used to obtain a high thrust in the desired direction when the ship is travelling at lower speeds or when stopped. In embodiments of the present invention, the sequence of movement for the blades can be determined either by theoretical studies or by actually conducting tests while the vessel is in water.

When the present invention is used passively, as a ship's rudder, the wheel body on which the blades are fastened is held stationary, and the blade or blades are then oriented according to instructions received from one or more control units. The control unit or units cause the blades to turn in the direction of the longitudinal axis of the ship. This movement in the direction of the longitudinal axis of the ship is accomplished by means of a transmission. The transmission consists of various sun wheels, planet wheels, intermediate wheels and chains or toothed belts, which are rotated by the transmission, and then in turn rotate the blades.

When the present invention is used as an active maneuvering mechanism, the transmission rotates the wheel body causing the blade or blades to move relative to the surrounding water. As a result of that movement of the blades, a thrust force is generated. That thrust force is a function of the position of the sun wheel or sun wheels present.

Additionally, the number of blades, the shape of the blades, the thickness of the blades, the location of the propeller, and the materials used can vary dependant upon the particular vessel and its demands.

BRIEF DESCRIPTION OF THE DRAWINGS

The device contemplated by the invention is illustrated in the accompanying drawings, whereby some details of the design and construction have been omitted, and the drawings merely show only a schematic plan view and side view of the wheel body with the blade and planetary transmission, wherein:

FIGS. 2*a* to 2*d* each show a different position of a blade on a device used as an active maneuvering mechanism, wherein FIG. 2*a* shows the device claimed by the invention used to generate forward thrust, FIG. 2*b* for reverse thrust, and FIGS. 2*c* and 2*d* for transverse thrust;

FIG. 3*a* shows a system in which a multiplicity of blades are used which can be set or adjusted individually;

FIG. 3*b* shows the position and orientation of a multiplicity of blades when the device claimed by the invention is used as a passive rudder;

DESCRIPTION OF THE PREFERRED EMBODIMENT

Figure 1:
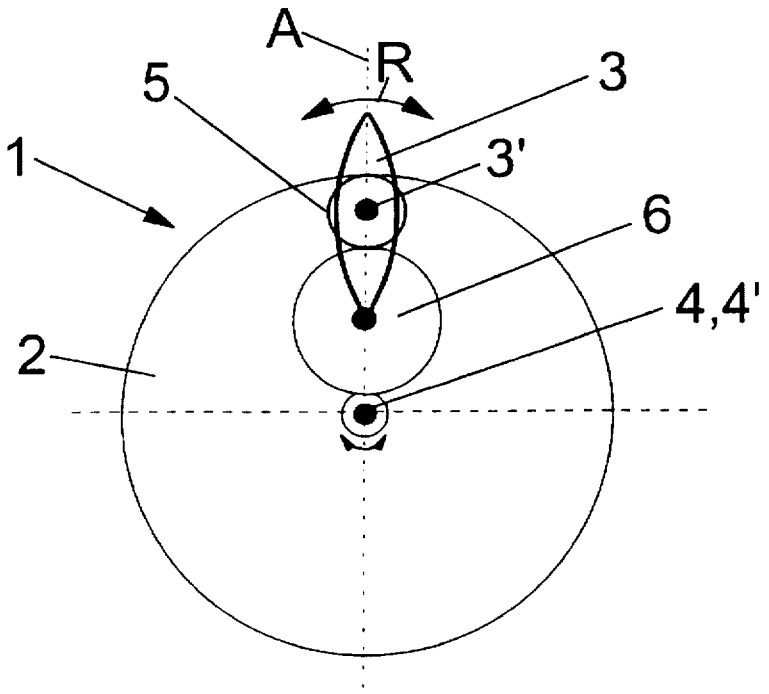
FIG. 1 shows the position of a blade when the device is used as a passive rudder.

FIG. 1 illustrates a device which operates independently of the ship's main propulsion system (not shown in FIG. 1), and is equipped with a wheel body 2 oriented horizontally and located in the vicinity of the bottom of the ship (not shown in FIG. 1), a single blade 3 which projects vertically downward from the wheel body, or, alternatively, a multiplicity of blades 3*a* and 3*b* which project vertically downward from the wheel body, a gearwheel transmission to change the position of the blade or blades, and a propulsion system (not shown in FIG. 1) for the wheel body 2.

An embodiment utilizing two blades 3*a* and 3*b* is illustrated in FIGS. 3*a* and 3*b*. It will be understood that, that any further discussion of a two-blade arrangement, or components associated therewith, can be best appreciated with reference to at least FIGS. 3*a* and 3*b*.

The wheel body 2 is mounted so that it can rotate around its center with respect to the bottom of the ship, and carries the blade 3 eccentrically, which is mounted so that it can rotate around its center axis, or the blades 3*a* and 3*b*, which are mounted so that they can rotate separately around their center axes, in the wheel body 2 and are provided with a symmetrical flow profile.

The gear wheel transmission is preferably realized in the form of a planetary transmission, the sun wheel 4 of which sits on a vertical center shaft 4' which runs through the center of the wheel body, or the sun wheels 4*a* and 4*b* of which sit on a corresponding number center shafts 4*a'* and 4*b'* which run vertically through the center of the wheel body. The planet wheel 5 of the planetary transmission is preferably connected with the axis of rotation 3' of the blade 3. Alternatively, planet wheels 5*a* and 5*b* are connected with axes of rotation 3*a'* and 3*b'* of the blades 3*a* and 3*b* respectively. Between the sun wheel 4 or the sun wheels 4*a* and 4*b* respectively, and the planet wheel 5 or the planet wheels 5*a* and 5*b* respectively, there is preferably an intermediate wheel 6 or intermediate wheels 6*a* and 6*b* mounted so that it/they can rotate in the wheel body 2 and is/are engaged with the two wheels.

In the operating status illustrated in FIG. 1 for a single blade, the wheel body 2 is blocked in a position so that the longitudinal axis of the rudder blade 3, when the blade is in the idle position, runs parallel to the longitudinal axis A of the ship, and in the event of rudder deflections, at corresponding angles to axis A.

In this case, the rudder deflections are transmitted from a control unit (not shown in FIG. 1) via the center shaft 4', the sun wheel 4, and by the latter via the intermediate wheel 6 to the planet wheel 5 and thus to the blade 3.

Figure 1D:
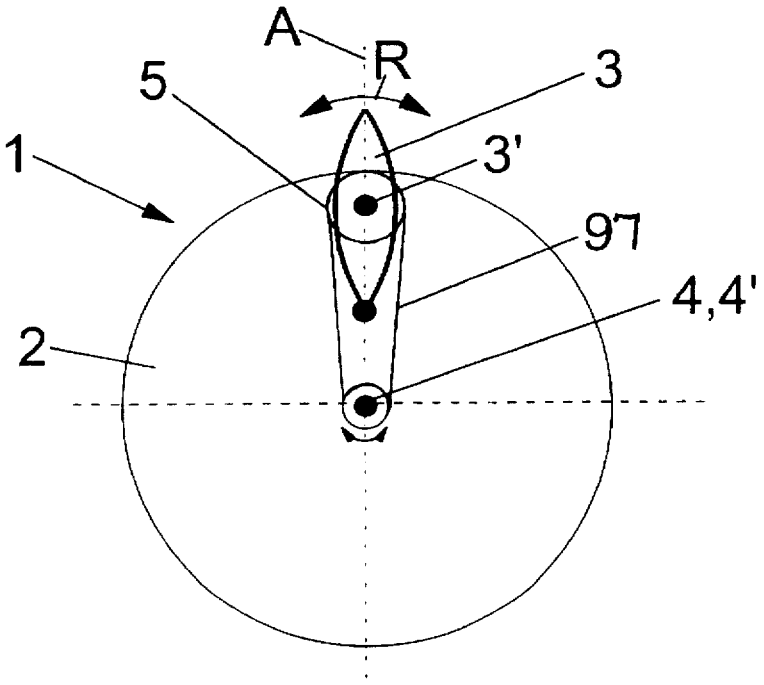
FIG. 1*d* shows a belt drive or chain drive in position.
Figure 1A:
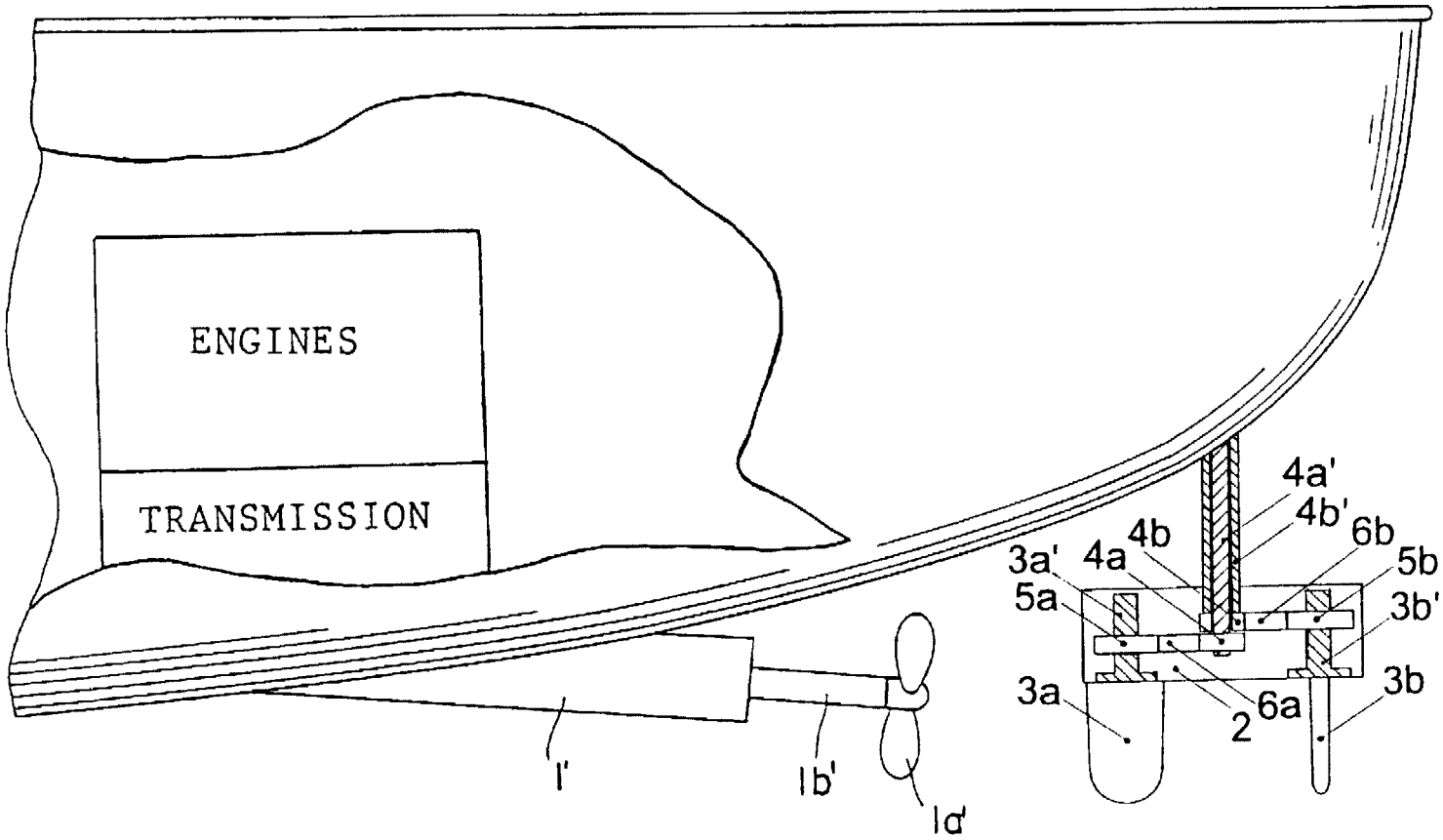
FIG. 1*a* shows a hull of a ship with the propeller in place.

FIG. 1*a* generally shows the bottom rear portion of a hull of a ship with propeller 1*a'*. Extending rearwardly from the hull is a stern tube 1'. The propeller shaft 1*b'* passes from the interior of the ship and to the exterior thereof through the stern tube 1'. The propeller 1*a'* can be affixed to the end of the shaft 1*b'*. FIG. 1*a* also illustrates the construction of the device according to an embodiment of the invention when a multiplicity of blades are used. By means of the center shafts 4*a'* and 4*b'* it is possible to achieve any desired orientation of the blades 3*a* and 3*b*. When the wheel body 2 rotates and the center shafts 4*a'* and 4*b'* are rotated, the blades 3*a* and 3*b* act as active maneuvering mechanisms and as a result of the simultaneous movement around their axes of rotation 3*a'* and 3*b'* generate a thrust, the direction of which is a result of the position of the installed and coupled sun wheels 4*a* and 4*b* and can be varied by 360°.

Figure 1B:
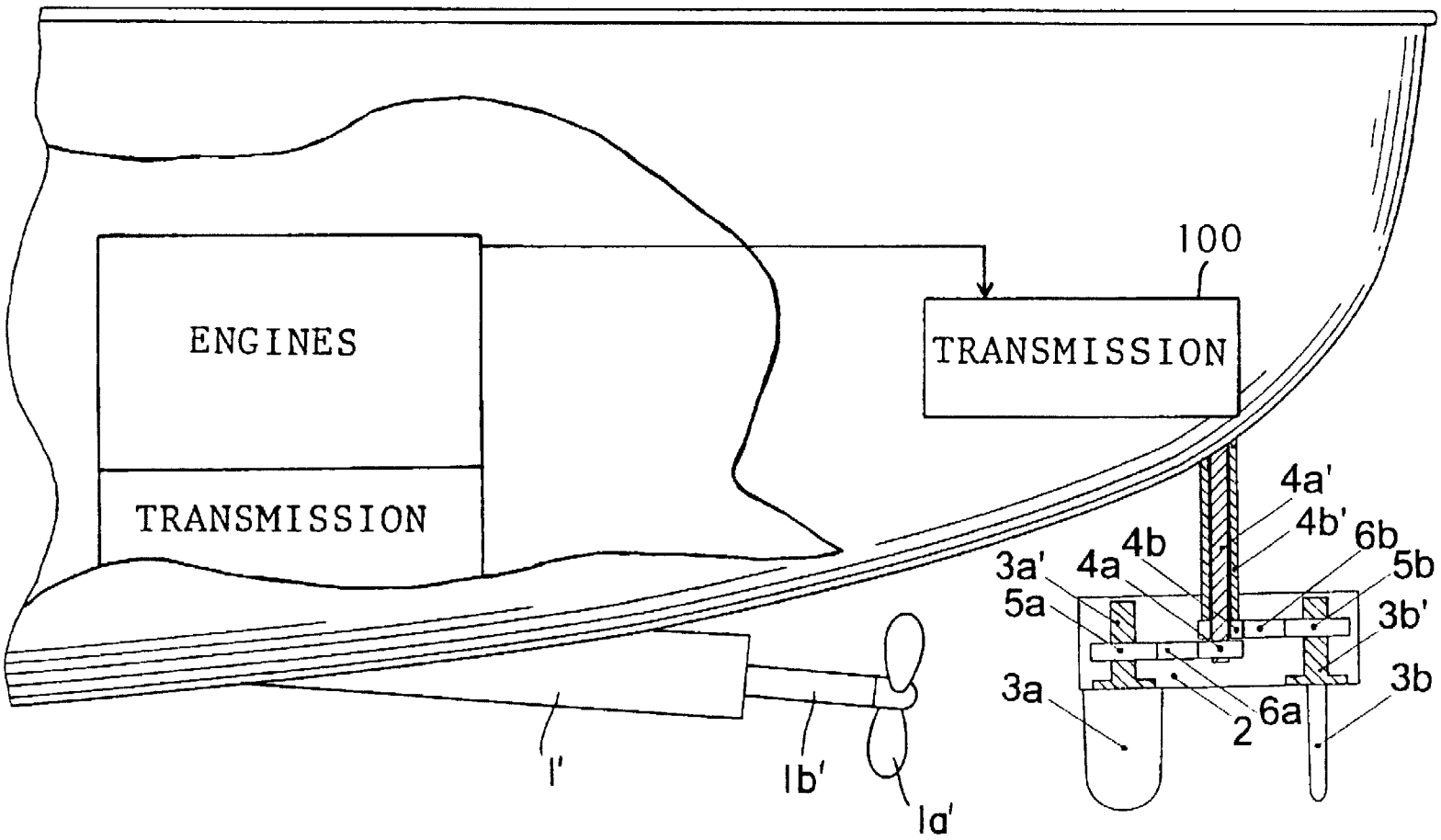
FIG. 1*b* shows a hull of a ship with the propeller in place and an additional transmission.

FIG. 1*b* generally shows the bottom rear portion of a hull of a ship with propellers 1*a'*, as shown in FIG. 1*a*. An additional power transmission 100 is shown.

Figure 1C:
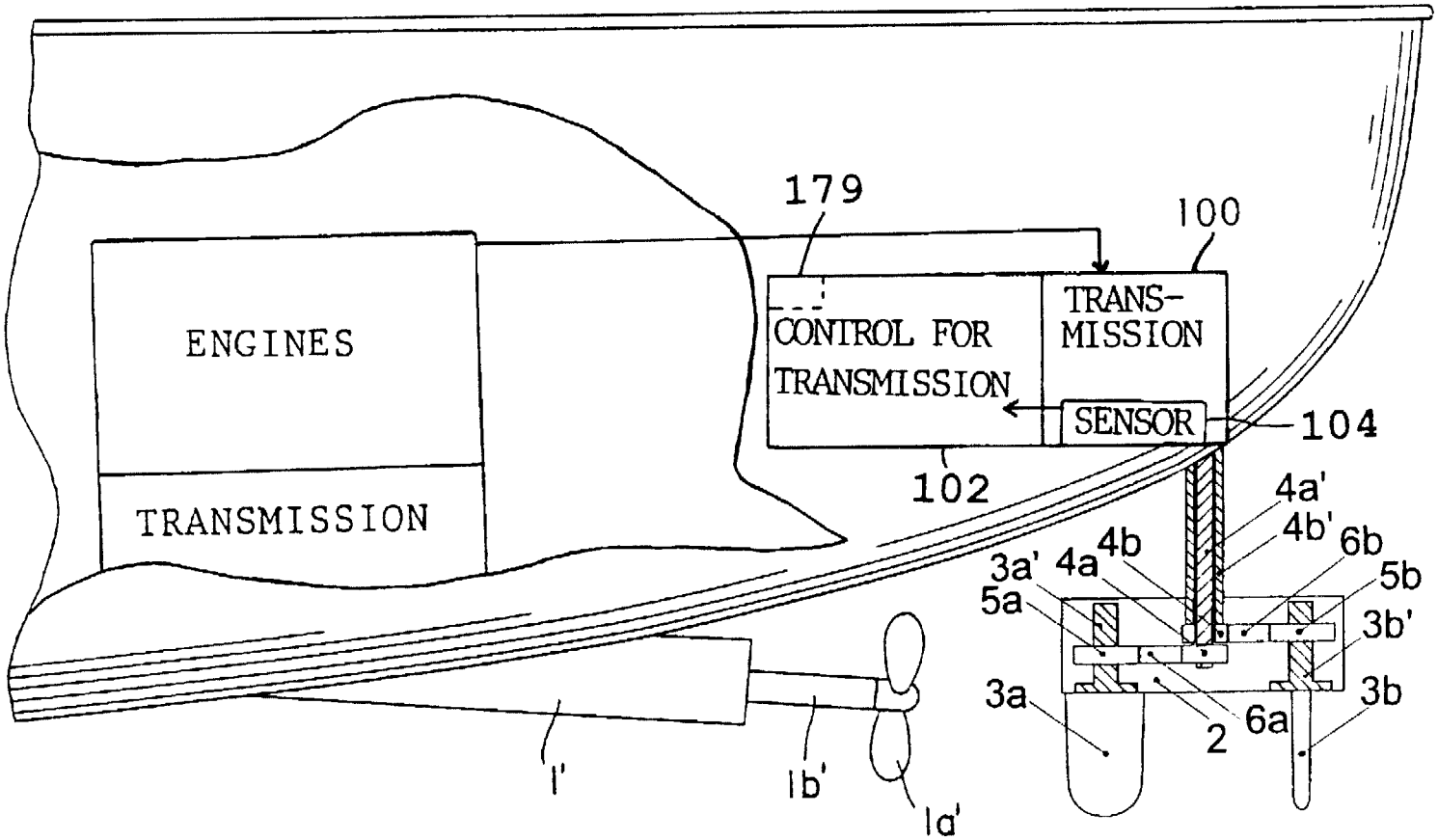
FIG. 1*c* shows a hull of a ship with the propeller in place, and an additional transmission and control unit.

FIG. 1*c* generally shows the bottom rear portion of a hull of a ship with propellers 1*a'*, as shown in FIGS. 1*a* and 1*b* .An additional transmission 100 is shown, as well as a control for the transmission 102. The control for the transmission 102 may also possibly have a computer arrangement 179 for rendering calculations appropriate to the transmission 100. A sensor 104 is also illustrated. The sensor 104 can be placed in the transmission 100 to sense the position of the wheel body 2 as well as the positions of the blades 3, 3*a*, 3*b*. In an additional embodiment of the present invention not illustrated, the sensor 104 can be located elsewhere in the transmission 100 or in another location other than in or near the transmission 100, such as in the wheel body 2. In one embodiment, the sensor 104 could be used to determine the actual positions of the blades 3, 3*a*, 3*b*, and permit computer arrangement 179 to determine revised positions, if the actual positions are different from the desired predetermined positions.

FIG. 1*d* is a further embodiment of FIG. 1*a*, however, in FIG. 1*d* a chain drive or toothed belt drive 97 is utilized in place of the intermediate wheel 6.

In the operating positions illustrated in FIGS. 2*a* to 2*d*, the individual blade 3 operates in each case as an active maneuvering mechanism, i.e. during its rotation with the wheel body 2 and the simultaneous movement around its axis of rotation 3', it generates a thrust, the direction of which results from the position of the sun wheel 4 and is variable by 360°.

To clearly explain the teaching of the invention, FIGS. 2*a* to 2*d* each show three positions of the blade 3 during its circular movement. The thrust force results from the buoyancy and resistance forces which act on the blade, or from solely the resistance forces which act on the blade.

Figure 2A:
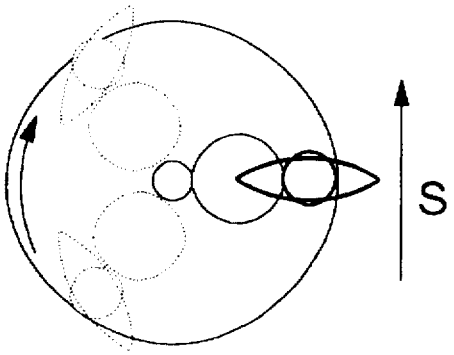
Figure 2B:
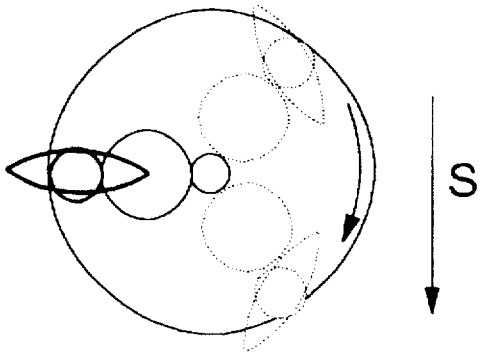
Figure 2C:
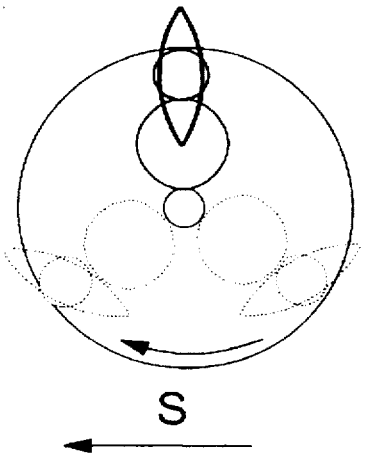
Figure 2D:
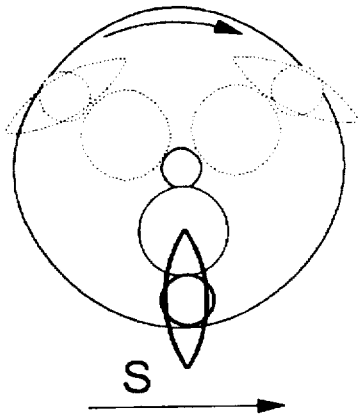
Figure 2E:
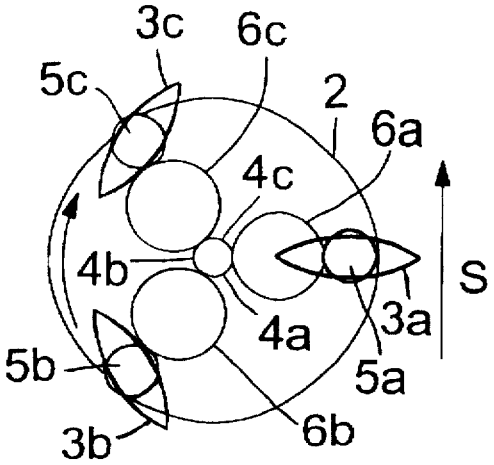
FIG. 2*e* is an alternative embodiment, similar to that shown in FIG. 3*d;*

In one embodiment of the invention, FIG. 2*e* shows a multiplicity of blades 3*a*, 3*b*, 3*c* in operation during circular movement. During the rotation of the wheel body 2, the blades 3*a*, 3*b*, 3*c* generate a thrust. The direction of the thrust results from the positions of the sun wheel 4*a*, 4*b*, 4*c*, and that position of the sun wheels 4*a*, 4*b*, 4*c* is variable by 360°. Additionally, each blade 3*a*, 3*b*, 3*c* has a respective planet wheel 5*a*, 5*b*, 5*c*, as well as an intermediate wheel 6*a*, 6*b*, 6*c*. The configuration of the three blades 3*a*, 3*b*, 3*c*, is further illustrated in FIG. 3*d*, and is analogous to FIGS. 2*a*–2*d*.

FIG. 3*a* describes the construction of the device according to an embodiment of the invention when a multiplicity of blades are used. By means of the center shafts 4*a'* and 4*b'* it is possible to achieve any desired orientation of the blades 3*a* and 3*b*. When the wheel body 2 rotates and the center shafts 4*a'* and 4*b'* are rotated, the blades 3*a* and 3*b* act as active maneuvering mechanisms and as a result of the simultaneous movement around their axes of rotation 3*a'* and 3*b'* generate a thrust, the direction of which is a result of the position of the installed and coupled sun wheels 4*a* and 4*b* and is can be varied by 360°.

In the operating status illustrated in FIG. 3*b*, where the device, according to one embodiment of the present invention, is being used as a passive rudder with a multiplicity of blades, the wheel body 2 is blocked in one position and the blades 3*a* and 3*b* are oriented by means of the center shafts 4*a*' and 4*b*' so that in the idle position, the longitudinal axes of the rudder blades run parallel to the longitudinal axis A of the ship. The rudder deflections are transmitted from one or more control units (not shown in FIG. 3*b*) by means of the coupled or uncoupled center shafts 4*a*' and 4*b*', the sun wheels 4*a* and 4*b*, and via the intermediate wheels 6*a* and 6*b* to the planet wheels 5*a* and 5*b*, and thus to the blades 3*a* and 3*b*.

Figure 3C:
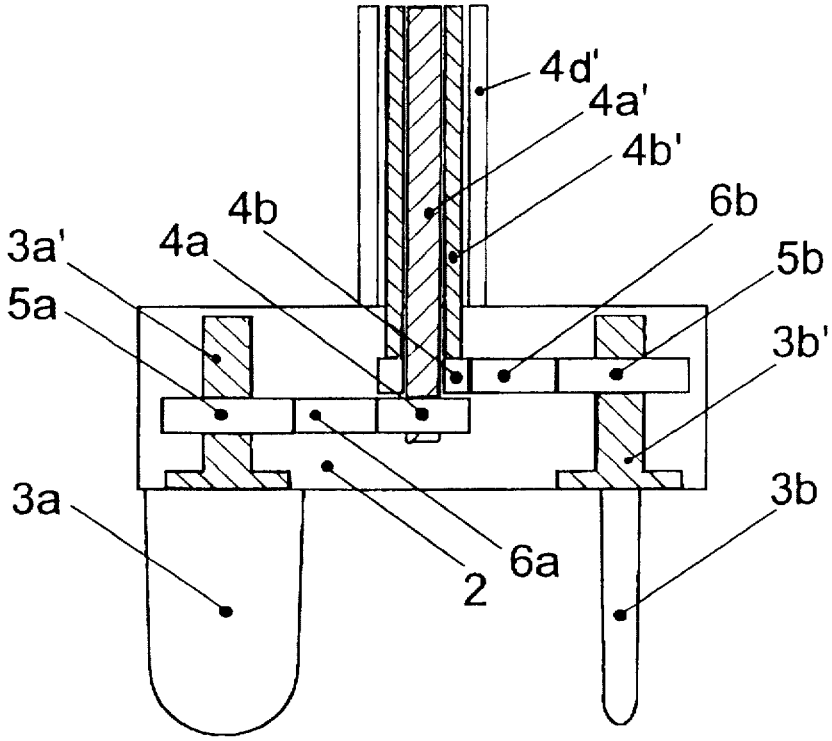
FIG. 3*c* shows the position and orientation of a multiplicity of blades.

FIG. 3*c* is essentially the same view as shown in FIG. 3*a*, however FIG. 3*c* has an added outer shaft 4*d*' which turns the wheel body 2, which shaft 4*d*' is also connected to the transmission 100 as shown in FIGS. 1*a*–1*c*. When the ship travels at high speed, the wheel body 2 is positioned in an appropriate position and blocked in this position by the transmission 100 (shown in FIG. 1*b*) by blocking shaft 4*d*' in the desired position. The various blades 3*a*, 3*b*, 3*c* can be blocked also in the wheel body 2 during high speed travel of the ship.

Figure 3D:
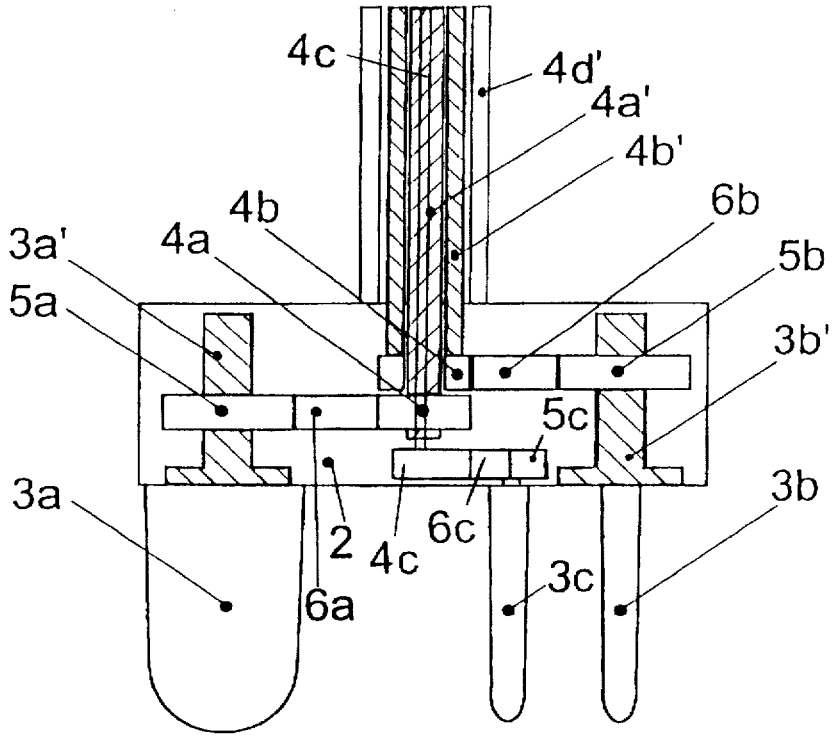
FIG. 3*d* shows the position and orientation of a multiplicity of blades.

FIG. 3*d* is essentially the same view as FIG. 3*a*, however FIG. 3*d* illustrates an additional propeller blade 3*c*, such as the additional propeller blade shown in FIGS. 2*a*–2*d*. It should be noted, that the additional propeller blade 3*c* requires an additional center shaft 4*c*" and an additional sun wheel 4*c*, an additional planet wheel 5*c*, and an additional intermediate wheel 6*c*.

To work effectively, a propeller preferably should be turned an ideal number of revolutions with respect to the level of power desired. Propellers with fixed blades, or with blades that do not allow 360° of rotation, hinder the ability of the engine to turn the propeller the ideal number of revolutions. The Voith-Schneider propeller does not have fixed blades, and does allow some movement of the blades. Essentially, the Voith-Schneider propeller is a horizontal disc, from which blades project vertically. As the horizontal disc and the blades rotate around a vertical axis, a mechanism allows the blades to "feather" or to move to provide a thrust in the desired direction. The desired directional thrust can then be obtained by changing the sequence of the blades movement. The present invention, however, unlike the Voith-Schneider propeller, allows the blades of the propeller to rotate 360°. By doing so, the present invention can not only be used as a passive, low-resistance rudder when the ship is cruising at high speeds, but the present invention can also be used to obtain a high thrust in the desired direction when the ship is travelling at lower speeds or when stopped. In embodiments of the present invention, the sequence of movement for the blades can be determined either by theoretical studies or by actually conducting tests while the vessel is in water.

When the present invention is used passively, as a ship's rudder, the wheel body on which the blades are fastened is held stationary, and the blade or blades are then oriented according to instructions received from one or more control units. The control unit or units cause the blades to turn in the direction of the longitudinal axis of the ship. This movement in the direction of the longitudinal axis of the ship is accomplished by means of a transmission. The transmission consists of various sun wheels, planet wheels, intermediate wheels and chains or toothed belts, which are rotated by the transmission, and then in turn rotate the blades.

When the present invention is used as an active maneuvering mechanism, the transmission rotates the wheel body causing the blade or blades to move relative to the surrounding water. As a result of that movement of the blades, a thrust force is generated. That thrust force is a function of the position of the blades and thus the sun wheel or sun wheels present. The present invention also allows that each blade can be manipulated or moved independently of the others as the wheel body rotates so that the thrust magnitude can be varied and adapted to the desired maneuver or maneuvers of the vessel.

The present invention is ideally utilized with large-tonnage ocean going vessels, such as freighters or warships or lake vessels or river vessels, typically having lengths of hundreds of feet, lengths of several hundreds of feet, and possibly even lengths of over a thousand feet.

Additionally, the number of blades, the shape of the blades, the thickness of the blades, the location of the propeller, and the materials used can vary dependant upon the particular vessel and its demands.

Examples of planet gears or planetary gears which may be exemplary of a feature of the present invention may be found in the following U.S. Patents: U.S. Pat. No. 4,378,220 to Seppala et al. on Mar. 29, 1983, entitled "Apparatus for and Method of Coupling Shafts"; U.S. Pat. No. 4,392,394 to Hofbauer et al. on Jul. 12, 1983, entitled "Engine-Gear Arrangement for Vehicles, in Particular Passenger Cars"; U.S. Pat. No. 4,417,485 to Boor on Nov. 29, 1983, entitled "Coupled Planetary Gear Speed Reducer for Use in Industrial Vehicles"; U.S. Pat. No. 4,428,254 to Hohn on Jan. 31, 1984 entitled, "Planetary Transmission"; U.S. Pat. No. 4,459,876 to Kohler on Jul. 17, 1984, entitled "Floating Planet Gear System"; U.S. Pat .No. 4,468,985 to Nilsson on Sep. 4, 1984, entitled "Planetary Gearing System"; and U.S. Pat. No. 4,569,252 to Harper on Feb. 11, 1986, entitled "Changegear Planetary Transmission".

Examples of ship propellers which may be exemplary of a feature of the present invention may be found in the following U.S. Patents: U.S. Pat. No. 5,374,208 to von Bergen et al. on Dec. 20, 1994, entitled "Ship, in Particular Deep Draft Vessel Having Concentric, Contra-Rotating Propellers"; U.S. Pat. No. 5,356,320 to Von Bergen et al. on Oct. 18, 1994, entitled "Seal Arrangement for Propeller Shafts of Ships"; U.S. Pat. No. 5,137,116 to Von Bergen et al. on Aug. 11, 1992, entitled "Sealing Device for a Rotating Shaft of a Ship Propeller Shaft"; U.S. Pat. No. 5,209,497 to Von Bergen et al. on May 11, 1993, entitled "Sealing Apparatus for Rotating Shafts, in Particular Stern Tube Seal for the Propeller Shafts of a Ship"; U.S. Pat. No. 4,419,085 to Laucks et al. on Dec. 6, 1983, entitled "Amphibious Vehicle"; and U.S. Pat. No. 4,465,431 to Gross on Aug. 14, 1984, entitled "Overload Protection Apparatus for Variable Pitch Propellers".

Examples of large ships in which the present invention can be utilized may be found in the following U.S. Patents: U.S. Pat. No. 4,898,112 to McGlew and McGlew, Jr. on Feb. 6, 1990, entitled "Cargo Ship Having Stowage Space for Floatable Self-Propelled Warehouses"; U.S. Pat. No. 5,140,925 to Tyring on Aug. 25, 1992, entitled "Arrangement in General Cargo Ships Having Side Port Openings"; U.S. Pat. No. 5,299,520 to Wilts on Apr. 5, 1994, entitled "Ship, in Particular Merchant Ship"; U.S. Pat. No. 4,586,908 to Schlichthorst on May 6, 1986, entitled "Exhaust Gas System for the Internal Combustion Engine of a Ship"; U.S. Pat. No. 4,643,643 to Otto on Feb. 17, 1987, entitled "Apparatus for Adjusting & Locking Pitch of a Variable Pitch Propeller on a Ship"; U.S. Pat. No. 4,711,193 to Latza and Mock on Dec. 8, 1987, entitled "Self-Contained Ventilation System Units for Supplying Spaces Between Bulkheads with Individually Circulated Ventilation Air"; and U.S. Pat. No. 4,843,989 to Langenberg on Jul. 4, 1989, entitled "Ship's Hull for Small Vessels and High Speeds".

Examples of ships and other water craft and vessels in which the present invention can be used in accordance with one embodiment of the present invention may be found in the following U.S. Patents: U.S. Pat. No. 5,141,456 to Langenberg et al. on Aug. 25, 1992, entitled "Water Craft with Guide Fins"; U.S. Pat. No. 4,843,989 to Langenberg on Jul. 4, 1989, entitled "Ship's Hull for Small Speed Vessels and High Speeds"; and U.S. Pat. No. 5,388,542 to Fischer et al. on Feb. 14, 1995, entitled "Water-Borne Ship and Method of Operation Thereof".

Examples of further propellers which may be exemplary of a feature of the present invention may be found in the following U.S. Patents: U.S. Pat. No. 4,900,280 to Midttun on Feb. 13, 1990, entitled "Apparatus for Detecting the Pitch of a Marine Controllable Pitch Propeller"; U.S. Pat. No. 5,171,170 to Ridder, et al. on Dec. 15, 1992, entitled "Ship's Drive with Trolling Device"; and U.S. Pat. No. 5,284,420 to Guimbal on Feb. 8, 1994, entitled "Plastics Multi-Blade Variable-Pitch Rotor".

Examples of rotary structures, parts or components of which may be exemplary of a feature of the present invention may be found in the following U.S. Patents: U.S. Pat. No. 5,188,511 to Ebert on Feb. 23, 1993; U.S. Pat. No. 5,188,512 to Thornton on Feb. 23, 1993; U.S. Pat. No. 5,190,243 to Guimbal on Mar. 2, 1993; U.S. Pat. No. 5,190,244 to Yana on Mar. 2, 1993; U.S. Pat. No. 5,199,851 to Perry et al. on Apr. 6, 1993; U.S. Pat. No. 5,205,715 to Perry et al. on Apr. 27, 1993; U.S. Pat. No. 5,209,430 to Wilson et al. on May 11, 1993; U.S. Pat. No. 5,213,282 to Gold et al. on May 25, 1993; U.S. Pat. No. 5,213,283 to Gold et al. on May 25, 1993; U.S. Pat. No. 5,225,844 to Williams on Jul. 6, 1993; U.S. Pat. No. 5,246,344 to Perry on Sep. 21, 1993; U.S. Pat. No. 5,253,979 to Fradenburgh et al. on Oct. 19, 1993; U.S. Pat. No. 5,265,825 to Ebert et al. on Nov. 30, 1993; and U.S. Pat. No. 5,372,478 to McCafferty on Dec. 13, 1994.

Some examples of sensors which may be exemplary of a feature of the present invention may be or are disclosed in the following U.S. Patents: U.S. Pat. No. 5,365,768 entitled "Sensor" to Hitachi; U.S. Pat. No. 5,197,326 entitled "Arrangement for Monitoring Rotational Speed Sensor" to Bosch; U.S. Pat. No. 5,239,263 entitled "Magnetic Rotation Sensor for Rotary Shaft"; U.S. Pat. No. 5,309,094 entitled "Bearing Rotary Speed Sensor with Concentric Multipole Magnetic Rings Axially aligned with Collector Branches"; and U.S. Pat. No. 5,192,877 entitled "Hall Effect Sensor and Component Providing Differential Detection".

Some examples of computer or electronic systems which may be exemplary of a feature of the present invention may be found in the following U.S. documents: U.S. Pat. No. 5,363,027 entitled "Apparatus and Method of Controlling the Robotic Driving of a Vehicle" to Horiba; U.S. Pat. No. 5,325,082 entitled "Comprehensive Vehicle Information Storage System" to Rodriguez; U.S. Pat. No. 5,253,272 entitled "Digital Data Transmission System with Adaptive Predistortion of Tranmsitted Pulses" to AMP Incorporated; and U.S. Pat. No. 5,299,200 entitled "Adaptive Interface that Automatically Adjusts for Timing Skews Caused by Signal Delays" to Sharp.

Examples of acceleration sensor arrangements, which may be exemplary of a feature of the present invention, may be found in the following U.S. Patents: U.S. Pat. No. 4,898,033, which issued to Yamamoto on Dec. 6, 1990; U.S. Pat. No. 4,903,982, which issued to Harara et al. on Feb. 27, 1990; U.S. Pat. No. 4,927,170, which issued to Wada on May 22, 1990; U.S. Pat. No. 4,930,082, which issued to Harara et al. on May 29, 1990; and U.S. Pat. No. 4,948,164, which issued to Hano et al. on Aug. 14, 1990.

Examples of lookup table arrangements and related arrangements, which may be exemplary of a feature of the present invention, may be found in the following U.S. Patents: U.S. Pat. No. 4,893,234, which issued to Davidson et al. on Jan. 9, 1990; U.S. Pat. No. 4,920,496, which issued to Szczebak, Jr., on Apr. 24, 1990; U.S. Pat. No. 4,968,985, which issued to Riggle et al. on Nov. 6, 1990; U.S. Pat. No. 4,974,078, which issued to Tsai on Nov. 27, 1990.

Examples of belt drives and/or toothed belt drives which may be exemplary of a feature of the present invention may be found in the following U.S. Patents: U.S. Pat. No. 5,178,566 to Stojkov et al. on Jan. 12, 1993, entitled "Marine Drive System with Belt Drive"; U.S. Pat. No. 5,187,828 to Hoffmann et al. on Feb. 23, 1993, entitled "Tractor Power Broom Apparatus"; U.S. Pat. No. 5,267,478 to Stridsberg on Dec. 7, 1993, entitled "Device for a Rapid Positioning of a Heavy Cartridge"; U.S. Pat. No. Re. 34485, Resissue of U.S. Pat. No. 4,929,221 to Tanaka et al. on Dec. 21, 1993, entitled "Power Transmission Toothed Belt and Drive"; U.S. Pat. No. 5,336,119 to Laid et al. on Aug. 9, 1994, entitled "Drive Unit for Relatively Small Watercraft"; U.S. Pat. No. 5,228,162 to Wu et el. on Jul. 20, 1993, entitled "Transmission and Balancing Mechanism for the Workpiece Supporting Arm of a Stitching Machine"; U.S. Pat. No. 5,234,387 to Fujiwara et al. on Aug. 10, 1993, entitled "Toothed Belt and Method for Producing the Same"; U.S. Pat. No. 5,277,668 to Pohn on Jan. 11, 1994, entitled "Gear Transmission, for Textile Machines"; U.S. Pat. No. 5,288,276 to Golovatgai-Schmidt, et al. on Feb. 22, 1994, entitled "Tightening Device for a Drive Belt"; and U.S. Pat. No. 5,346,439 to Lynch on Sep. 13, 1994, entitled "Toothed Transmission Belt".

Examples of chain drives which may be exemplary of a feature of the present invention may be found in the following U.S. Patents: U.S. Pat. No. 5,183,444 to Robbin on Feb. 2, 1993, entitled "Continuously Variable Transmission"; U.S. Pat. No. 5,184,488 to Sandlin on Feb. 9, 1993, entitled "Marine Outdrive Locking Device"; U.S. Pat. No. 5,188,199 to Shirai on Feb. 23, 1993, entitled "Warehousing Traveling Crane"; U.S. Pat. No. 5,192,251 to Tuomikoski on Mar. 9, 1993, entitled "Transmission Chain Structure"; U.S. Pat. No. 5,197,420 to Arnold et al. on Mar. 30, 1993, entitled "Camshaft Adjuster and Tensioner"; and U.S. Pat. No. 5,203,100 to Snyder and Snyder on Apr. 20, 1993, entitled "Offset Ditcher with Chain Drive".

One feature of the invention resides broadly in the device which is independent of the main propulsion system and can be used as a maneuvering mechanism for ships, on which long blades are mounted eccentrically on a horizontal wheel body mounted so that it can rotate around its center, which blades can rotate around a vertical axis, so that in operation, when the wheel body rotates, the blades can execute a movement via a power transmission system to effect a forward thrust, characterized by the modification of the design described above, such that on the device, which can be used selectively as a passive rudder or as an active maneuvering mechanism for ships, one or more longitudinal blades are mounted eccentrically on a horizontal wheel body mounted so that it can rotate around its center, whereby the blades are mounted so that they can rotate around a vertical axis, and on which the wheel body and a single blade can be driven by means of a sun wheel, or a multiplicity of blades can be driven separately by means of a multiplicity of sun wheels, that when the device is used as a passive ship's rudder, the wheel body 2 is held stationary, and the blade or blades, in response to instructions from one or more control units, are oriented in the direction of the longitudinal axis of the ship by means of a transmission which consists of a center shaft 4' or a multiplicity of center shafts 4a', 4b', a sun wheel 4 or a multiplicity of sun wheels 4a, 4b, a intermediate wheel 6 or a multiplicity of intermediate wheels 6a, 6b and a wheel 5 connected to the blade or a multiplicity of wheels 5a, 5b connected to the blades, and likewise the necessary rudder deflections are transmitted to the blade 3 or to the blades 3a, 3b, that when the device is used as an active maneuvering mechanism, the center shaft 4' or the center shafts 4a', 4b' and thus the sun wheel 4 or the sun wheels 4a, 4b are oriented according to the desired direction of the thrust, which can be varied by 360°, and then with a sun wheel 4 or sun wheels 4a, 4b held stationary for one thrust direction, the wheel body 2 rotates so that as a result of the action of the planetary transmission, the blade 3 or the blades 3a, 3b execute a movement relative to the surrounding water, as a result of which a thrust force is generated which is directed as a function of the position of the sun wheel 4 or of the sun wheels 4a, 4b.

Another feature of the invention resides broadly in the device characterized by the fact that the blade or blades are adjusted by means of a transmission which consists of sun wheels, planet wheels, a multiplicity of intermediate wheels and chains or toothed belts.

Yet another feature of the invention resides broadly in the device characterized by the fact that the blade 3 or the blades 3a, 3b are equipped with a symmetrical flow profile with respect to its/their longitudinal axis.

Still another feature of the invention resides broadly in the system, located in the bow and/or stern area of the ship.

The invention as described hereinabove in the context of the preferred embodiments is not to be taken as limited to all of the provided details thereof, since modifications and variations thereof may be made without departing from the spirit and scope of the invention.

What is claimed is:

1. A ship comprising:

a hull;

said hull being disposed from bow to stern;

at least one engine disposed within said hull;

a main propulsion system;

means for connecting said main propulsion system to said at least one engine;

an auxiliary maneuvering device;

said auxiliary maneuvering device being independently operable of said main propulsion system;

said auxiliary maneuvering device comprising a body;

at least one blade extending from said body;

said auxiliary maneuvering device comprising means for both providing a rudder system for said ship by aligning said at least one blade with respect to the longitudinal axis of said ship upon use of said main propulsion system and also for propelling said ship;

said body defining a horizontal plane and said body comprising a center;

said body being substantially circular and the plane of said body being disposed substantially horizontally with respect to said ship;

means for rotating said body with respect to said hull;

means for connecting said body to said at least one engine to rotate said body around the center of said body;

said at least one blade defining a vertical axis;

said at least one blade defining a root portion substantially adjacent said body, and a tip portion substantially distal from said body;

said vertical axis of said at least one blade extending from said root portion of said at least one blade to said tip portion of said at least one blade;

means for rotating each of said at least one blade at least 360° about the vertical axis of said at least one blade;

said means for rotating each of said at least one blade at least 360° comprising at least one transmission means;

said at least one transmission means being connected to said at least one engine.

2. The ship according to claim 1, including means for controlling said at least one blade to rotate said at least one blade to a plurality of desired positions;

said means for providing a rudder system for said ship by aligning said at least one blade with respect to the longitudinal axis of said ship upon use of said main propulsion system comprising means for adjusting said at least one blade to act as at least one rudder.

3. The ship according to claim 2, wherein said means for controlling comprising means for moving said at least one blade, during rotation of said body, to generate a desired thrust.

4. The ship according to claim 3 wherein said means for moving said at least one blade comprise a planetary gear system.

5. The ship according to claim 4 wherein said planetary gear system comprises:

at least one sun gear;

at least one intermediate wheel; and at least one planet wheel.

6. The ship according to claim 5, wherein said means for rotating said at least one blade comprises said planetary gear system.

7. The ship according to claim 6, wherein said means for rotating each of said at least one blade at least 360° comprises said at least one sun wheel;

said at least one sun wheel being connected to rotate said at least one planet wheel.

8. The ship according to claim 7, wherein said means for rotating each of said at least one blade at least 360° comprises at least one shaft disposed at least between said hull and said body;

each of said at least one sun wheel being connected to a corresponding one of said at least one shaft.

9. The ship according to claim 8, wherein said at least one planet wheel is connected to said at least one blade.

10. The ship according to claim 9 wherein:

said at least one shaft comprises a plurality of shafts;

said at least one sun gear comprises a plurality of sun gears;

said at least one planet wheel comprises a plurality of planet wheels; and said at least one blade comprises a plurality of blades.

11. The ship according to claim 10, wherein said at least one blade comprises a symmetrical flow profile with respect to the width dimension of said at least one blade.

12. The ship according to claim 11, wherein said auxiliary maneuvering device is disposed in one of:

a) said bow area of said ship;

b) said stern area of said ship.

13. The ship according to claim 5 wherein said means for rotating said at least one blade comprises at least one chain drive.

14. The ship according to claim 13 wherein: said means for rotating each of said at least one blade at least 360° comprises:

said at least one chain drive;

said at least one chain drive being connected to rotate said at least one blade;

at least one shaft disposed at least between said hull and said body; and said at least one chain drive being connected to a corresponding one of said at least one shaft;

said at least one blade comprises a symmetrical flow profile with respect to the width dimension of said at least one blade; and said auxiliary maneuvering device is disposed in one of:

a) said bow area of said ship;

b) said stern area of said ship.

15. The ship according to claim 5 wherein said means for rotating said at least one blade comprises at least one toothed belt drive.

16. The ship according to claim 15 wherein:

said means for rotating each of said at least one blade at least 360° comprises:

said at least one toothed belt drive;

said at least one toothed belt drive being connected to rotate said at least one blade;

at least one shaft disposed at least between said hull and said body; and said at least one toothed belt drive being connected to a corresponding one of said at least one shaft;

said at least one blade comprises a symmetrical flow profile with respect to the width dimension of said at least one blade; and said auxiliary maneuvering device is disposed in one of:

a) said bow area of said ship;

b) said stern area of said ship.

17. A ship comprising:

a hull;

said hull being disposed from bow to stern;

at least one engine disposed within said hull;

a main propulsion system;

means for connecting said main propulsion system to said at least one engine;

an auxiliary maneuvering device;

said auxiliary maneuvering device being independently operable of said main propulsion system;

said auxiliary maneuvering device comprising a body;

at least one blade extending from said body;

said auxiliary maneuvering device comprising means for both providing a rudder system for said ship by aligning said at least one blade with respect to the longitudinal axis of said ship upon use of said main propulsion system and also for propelling said ship;

said body defining a plane therethru and said body comprising a center;

said body being substantially circular and the plane of said body disposed with respect to said ship;

means for rotating said body with respect to said hull;

means for connecting said body to said at least one engine to rotate said body around the center of said body;

said at least one blade defining a longitudinal axis;

said at least one blade defining a root portion substantially adjacent said body, and a tip portion substantially distal from said body;

said longitudinal axis of said at least one blade extending from said root portion of said at least one blade to said tip portion of said at least one blade;

means for rotating each of said at least one blade about 360° about the vertical axis of said at least one blade;

said means for rotating each of said at least one blade about 360° comprising at least one transmission means;

said at least one transmission means being connected to said at least one engine.

18. The ship according to claim 17, including means for controlling said at least one blade to rotate said at least one blade to a plurality of desired positions.

19. The ship according to claim 18, wherein said means for controlling comprising means for moving said at least one blade, during rotation of said body, to generate a desired thrust.

20. A ship according to claim 19, wherein said at least one blade has a width dimension and a thickness dimension;

said width dimension being substantially thicker than said thickness dimension;

both said width dimension and said thickness dimension being substantially transverse to said vertical axis of said blade;

said means for controlling comprising means for disposing the width dimension of said at least one blade substantially parallel to the longitudinal axis of said hull during the running of said ship at high speed.

* * * * *

UNITED STATES PATENT AND TRADEMARK OFFICE

CERTIFICATE OF CORRECTION

PATENT NO. : 5,632,661

DATED : May 27, 1997

INVENTOR(S) : Dr. Dirk JÜRGENS and Christian THIEME

It is certified that error appears in the above-identified patent and that said Letters Patent is hereby corrected as shown below:

In column 5, line 27, after 'shaft', delete " 4c" " and insert --4c'--.

In column 5, line 43, after the second occurrence of 'the', delete "blades" and insert --blades'--.

Signed and Sealed this

Ninth Day of September, 1997

*Attest:*

*Attesting Officer*

BRUCE LEHMAN

*Commissioner of Patents and Trademarks*